US007351305B2

(12) United States Patent
Snekkenes

(10) Patent No.: US 7,351,305 B2
(45) Date of Patent: Apr. 1, 2008

(54) METHOD AND A DIGESTER FOR THE CONTINUOUS COOKING OF WOOD RAW MATERIAL TO CELLULOSE PULP

(75) Inventor: Vidar Snekkenes, Karlstad (SE)

(73) Assignee: Metso Fiber Karlstad AB (SE)

( * ) Notice: Subject to any disclaimer, the term of this patent is extended or adjusted under 35 U.S.C. 154(b) by 474 days.

(21) Appl. No.: 10/517,621

(22) PCT Filed: Jun. 23, 2003

(86) PCT No.: PCT/SE03/01065

§ 371 (c)(1),
(2), (4) Date: Dec. 10, 2004

(87) PCT Pub. No.: WO2004/005609

PCT Pub. Date: Jan. 15, 2004

(65) Prior Publication Data

US 2006/0162880 A1 Jul. 27, 2006

(30) Foreign Application Priority Data

Jul. 3, 2002 (SE) ..... 0202060

(51) Int. Cl.
*D21C 3/26* (2006.01)

(52) U.S. Cl. ..... 162/17; 162/52; 162/49; 162/19; 162/60

(58) Field of Classification Search ..... 162/17, 162/19, 52, 49, 237, 246, 263, 43, 45, 60, 162/29, 37, 40
See application file for complete search history.

(56) References Cited

U.S. PATENT DOCUMENTS

| | | | | |
|---|---|---|---|---|
| 4,780,181 | A * | 10/1988 | Lind | 162/17 |
| 5,919,337 | A * | 7/1999 | Olsson et al. | 162/17 |
| 6,123,807 | A * | 9/2000 | Engstrom et al. | 162/17 |
| 6,605,180 | B2 * | 8/2003 | Snekkenes et al. | 162/17 |
| 6,699,357 | B2 * | 3/2004 | Snekkenes et al. | 162/17 |
| 2002/0079071 | A1 * | 6/2002 | Snekkenes et al. | 162/43 |

* cited by examiner

*Primary Examiner*—Mark Halpern
(74) *Attorney, Agent, or Firm*—Rolf Fasth; Fasth Law Offices

(57) ABSTRACT

The digester and method are for the continuous cooking of pulp. At least two withdrawal positions (11E, 11D) for cooking fluid are arranged at different heights in the digester (10). The cooking fluid in the first and second position is withdrawn after the chips have had a retention time that differs by at least 10 minutes. The differential pressure between the positions is determined and when this exceeds a pre-determined level, a connection (17E) opens between these positions, establishing a flow parallel to a flow of cooking fluid between these positions in the digester. Several withdrawal positions are preferably connected in a common shunt system (17A-17F), with valves (18A-18F), controlled by the differential pressure, that are located between adjacent positions.

10 Claims, 4 Drawing Sheets

METHOD AND A DIGESTER FOR THE CONTINUOUS COOKING OF WOOD RAW MATERIAL TO CELLULOSE PULP

PRIOR APPLICATION

This application is a U.S. national phase application based on International Application No. PCT/SE2003/001065, filed 23 Jun. 2003, claiming priority from Swedish Patent Application No. 0202060-0, filed 3 Jul. 2002.

The present invention concerns a method and a digester for the continuous cooking of wood raw material for the production of cellulose pulp.

THE PRIOR ART

Vertical cooking vessels are used during the production of cellulose pulp in continuous cooking plants where the wood raw material and the cooking fluid are fed in at the top of the vessel and the cooked pulp is output continuously at the bottom of the digester.

Each such digester has been initially dimensioned for a certain production level, typically 500-2,000 tonnes of pulp per day. When an increase in the production capacity of existing digesters is desired it an increase in the chip speed, i.e. the speed at which the column of chips sinks in the digester, and problems arise if zones are present in the digester having countercurrent flow of cooking fluid or washing fluid, something that is primarily used in the final cooking zones of the digester.

One way of increasing the production is to convert the complete cooking process in the digester, or a major part of it, to what is known as concurrent cooking. This makes an increase in production possible.

The problems associated with countercurrent flow at the bottom of the digester can be partially reduced by shortening the zone of countercurrent flow, something that most often occurs by the lower withdrawal strainers in the digester being moved downwards towards the outlet.

Other methods may involve the introduction of a fraction, known as a "cheater flow", of the washing fluid that is normally added to the bottom of the digester at the lowest digester flow. Such a cheater flow reduces the dilution factor (the wash) at the bottom of the digester, and instead moves the added washing fluid downwards, as part of the cooking fluid that flows downwards, while in certain digesters it moves as part of the cooking fluid that is drawn upwards through the column of chips in a countercurrent flow over the lowest cooking strainer.

A balance is required In all of these solutions with the aim of increasing production with respect to the risk of clogging and hanging of the column of chips, since the increased speed of the column of chips is most often combined with increased withdrawal flows and circulatory flows of the cooking and washing fluids. The risks for channelling of the added cooking fluids also increases, which leads to an uneven result of the digestion with different degrees of delignification for the cellulose pulp that is fed out from the digester. This means that subsequent delignification and bleaching stages are more difficult to carry out, since the input pulp does not have a constant degree of delignification.

The Aim and Purpose of the Invention

The principal aim of the invention is to establish a continuous cooking method that has an increased production capacity and that dramatically reduces the risk for hanging of the pulp in the digester and a subsequent stoppage of the process.

A second aim is to increase the degree of washing in a continuous digester in digesters having increased production capacity.

A further aim is to reduce the risk of channel formation in the digester in digesters having increased production capacity.

A further aim is to be able to cook the pulp with a greater degree of homogeneity and a stable degree of delignification in digesters having an increased production capacity.

A further aim is to increase the level of operation in digesters having an increased production capacity, where it is permitted to run the digester closer to its optimal capacity not only with respect to production capacity (tonnes/day) but also with respect to optimal degree of delignification, and where the cooking system can automatically correct the cooking process depending upon instantaneous disturbances in the withdrawal flow from the digester. The digester can, in preferred embodiments, be run closer to the optimal countercurrent flow, where any necessary shunting of the countercurrent flow is at any moment kept to a minimum.

The invention finds application primarily in continuous digesters where these have become overloaded through earlier upgrades with the aim of increasing the production capacity, and are run at the limit of what is possible with respect to the countercurrent flow in the digester of cooking or washing fluid, and where it is desired to increase the production capacity further. It is primarily, existing overloaded cooking plants that can be improved through the method according to the invention and modification of the digester, and an increase in capacity can be obtained without the need to invest in a complete new cooking plant costing tens of millions of Euro. However, the invention is not limited to the upgrade of existing cooking plants. It can also be used in totally new continuous cooking plants, since the level of operation is dramatically improved with a reduced risk of hanging (stoppage) in the digester.

DETAILED DESCRIPTION OF PREFERRED EMBODIMENTS

Figure 1:
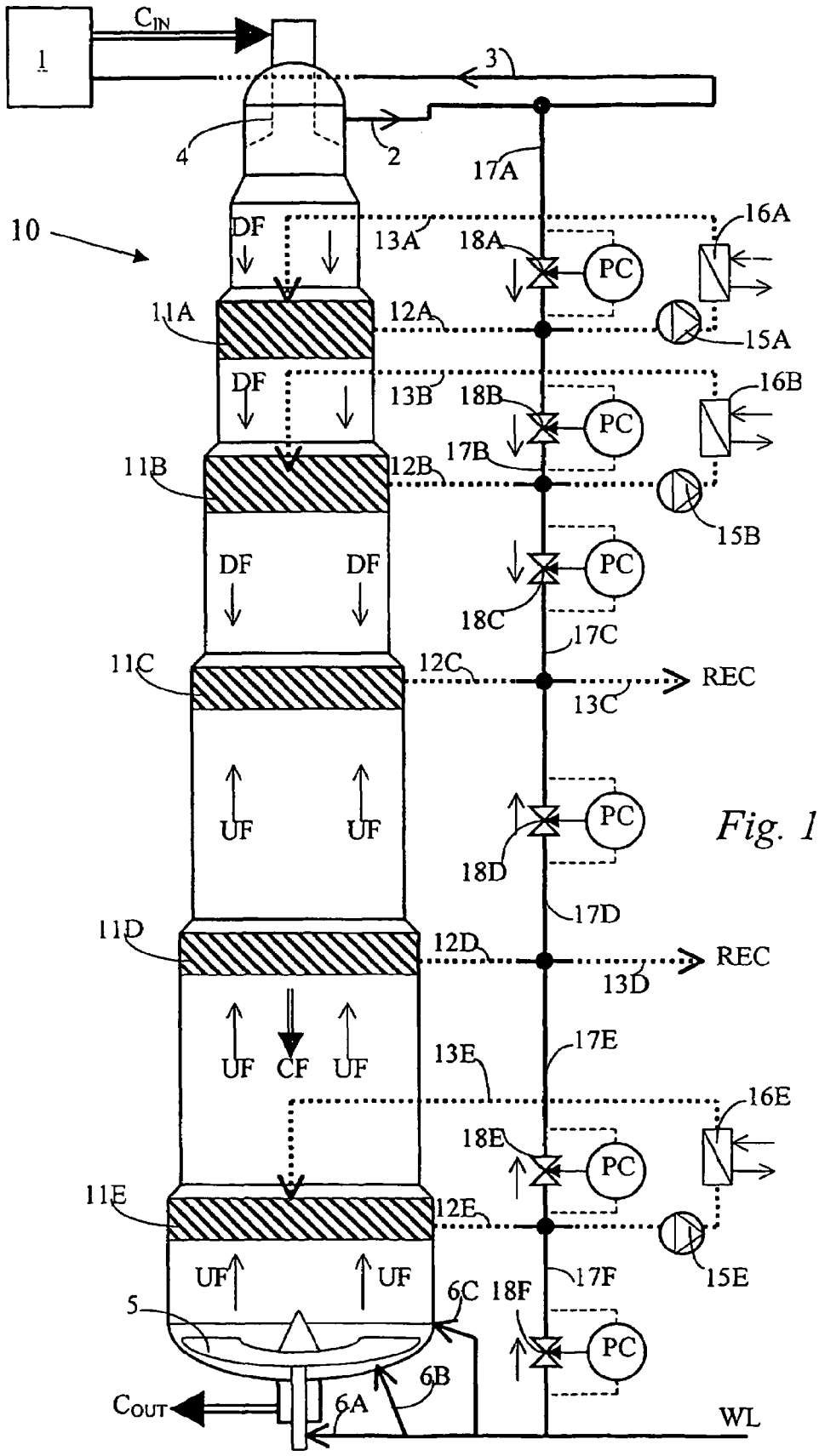
FIG. 1 shows schematically a digester according to the invention with which the method according to the invention can be run.

FIG. 1 shows a digester that has been modified so that it can apply the method according to the invention. When cooking wood raw material in a continuous manner for the production of cellulose pulp, the wood raw material and cooking fluid $C_{IN}$ are fed in at the top of the continuous digester. A cooking temperature of 130-170° C. is established in the cooking vessel while the wood raw material experiences a retention time of at least 90 minutes at this temperature. The wood raw material sinks continuously through the digester from its top to its bottom, and is then finally fed out $C_{OUT}$ from the bottom of the digester with the aid of a bottom scraper 5 that feeds the chips towards the outlet during remixture and addition of washing and/or dilution fluid WL to the bottom of the digester through addition nozzles 6A-6C. Washing and/or dilution fluid WL is added through a pressurised washing fluid line (WL/6), and it is normally added both at the bottom of the digester through nozzles 6B and at the periphery of the digester just above the outer ends of the scraper, via nozzles 6A arranged on the bottom scraper.

Several withdrawal positions 11A-11E for cooking fluid are arranged at various heights in the digester. Each withdrawal position is preferably constituted by at least one row of cooking strainers that are located around the complete circumference of the digester. Thus, several rows of strainers can be arranged at each withdrawal position where these rows of strainers can be located closely above each other.

According to the invention, at least a first and a second withdrawal position are co-ordinated, where the cooking fluid in the first and the second withdrawal positions is withdrawn through a strainer after the wood raw material has had a retention time in the digester that differs by at least 10 minutes, and preferably by at least 20 minutes. The first and the second withdrawal positions are preferably separated in height in the digester by at least 2 meters and preferably by at least 5 meters, depending on the cooking process used and the production capacity of the digester.

The cooking fluid is withdrawn from the digester at the relevant withdrawal position through a strainer arranged in the wall of the digester and is led onwards through a withdrawal line 12A-12E.

A regulator valve 18A-18F is arranged in a shunt line 17A-17F, 24 between the withdrawal lines for the first and the second withdrawal lines at the withdrawal positions, which regulator valve is controlled by a differential pressure gauge PC, which is arranged to determine not only the pressure in the withdrawal line of the first withdrawal position but also the pressure in the withdrawal line of the second withdrawal position.

The differential pressure between the two withdrawal positions is thus determined by the differential pressure gauge PC and when this differential pressure exceeds a pre-determined first level a connection in the shunt line between these positions is opened. A flow is then established in the connection, the direction of which is parallel to the flow of fluid of free cooking fluid that is established in the digester between these withdrawal positions.

The Simplest Embodiment

In a first implementation of the invention, a shunt line 17E is located between the withdrawal line 12E of the lowest strainer and the withdrawal line 12D at the withdrawal position that lies immediately above it. If a flow UF of cooking fluid directed upwards in the figure is established in the corresponding cooking zone between the strainers 11E and 11D, as is indicated in FIG. 1, then the regulator in the shunt line 17E will be adjusted such that the regulator valve 18E opens for a flow through the valve as is indicated, that is, a flow in the shunt line 17E that is parallel with the countercurrent flow UF, when the differential pressure measured by the differential pressure gauge PC between the withdrawal line 12D that lies above and the withdrawal line 12E that lies below falls below a pre-determined threshold value $P_{Th}$. It is appropriate that this threshold value $P_{Th}$ is set to a level of pressure difference of 0.1-1.0 bar between the pressure $P_{12D}$ in the withdrawal line 12D and the pressure $P_{12E}$ in the withdrawal line 12E, according to:

$$P_{12D}-P_{12E}\leq P_{Th}\Rightarrow \text{Valve 18}E\text{ opens.}$$

It is to be preferred that compensation is carried out for the static height (the height difference) between the strainer sections $P_{OFFSET_D/E}$, where P corresponds to the difference in static pressure between these two heights 12E and 12D, such that the regulator function becomes:

$$P_{12D}-P_{12E}-P_{OFFSET_D/E}\leq P_{Th}\Rightarrow \text{Valve 18}E\text{ opens.}$$

Transfer of withdrawal flow from strainer 11E to 11D is achieved with this regulator function as soon as the current pressure in the withdrawal line 12D indicates that clogging has occurred in the digester.

Embodiment with Two Shunt Lines Between Three Withdrawal Positions

The invention can be furthermore implemented where the first withdrawal position is constituted by a withdrawal strainer 11E that is located at the bottom of the digester in the wall section of the digester, and where the second withdrawal position is constituted by a withdrawal strainer 11D that is located above the first withdrawal strainer at a distance that ensures that wood raw material has had at least 10 minutes, preferably 20 minutes, shorter retention time in the digester and where the physical distance between the strainers is at least 2 meters and preferably at least 5 meters, and where the digester has a third withdrawal position 11C above the second withdrawal position where cooking fluid is withdrawn at this third withdrawal position after the wood raw material has had a retention time in the digester that is shorter and differs from that at the second withdrawal position by at least 10 minutes, and preferably at least 20 minutes. A regulator valve 18D is located in this embodiment in a shunt line 17D between the withdrawal lines for the withdrawal lines at the second and third withdrawal positions, 12D and 12C, which regulator valve 18D is controlled by a differential pressure gauge PC that is arranged to determine both the pressure in the withdrawal line 12C at the second withdrawal position and the pressure in the withdrawal line 12D at the third withdrawal position. The differential pressure between the second and third withdrawal positions can be determined in this way, and a connection is opened between these withdrawal positions when this differential pressure exceeds a pre-determined level.

If an upwards countercurrent flow UF of cooking fluid has been established in the corresponding cooking zone in the digester between the strainers 11C and 11D, as is indicated in FIG. 1, the regulation in the shunt line 17D is adjusted so that the regulator valve 18D opens for a flow through the valve as is indicated, that is, a flow in the shunt line 17D that is parallel to the countercurrent flow MF, when the differential pressure between the withdrawal line 12C that lies above and the withdrawal line 12D that lies below, when measured by the differential pressure gauge PC, falls below a pre-determined threshold value $P_{Th}$. It is appropriate if this threshold value $P_{Th}$ is set at a level of a pressure difference of 0.1-1.0 bar between the pressure $P_{12C}$ in the withdrawal line 12C and the pressure $P_{12D}$ in the withdrawal line 12D according to:

$$P_{12C}-P_{12D}\leq P_{Th}\Rightarrow \text{Valve 18}D\text{ opens.}$$

Preferably it is here that compensation is carried out for the static height (height difference) between the strainer sections $P_{OFFSET_D/E}$, where P corresponds to the difference in static pressure between these height positions 12D and 12C, such that the regulator function then becomes:

$$P_{12C}-P_{12D}-P_{OFFSET_C/D}\leq P_{Th}\Rightarrow \text{Valve 18}D\text{ opens.}$$

Transfer of withdrawal flow from strainer 11D to 11EC is achieved with this regulator function as soon as the current pressure in the withdrawal line 12D indicates that clogging has occurred in the digester.

When this functionality is connected from the lowest strainer 11E right up to the highest strainer 11C where countercurrent flow of cooking fluid is established in the digester between these strainers, from 11E up to 11C, successive withdrawal flows from the withdrawal line 12E can be transferred to withdrawal line 12D if it is indicated that clogging has occurred in the digester at strainer 11D, and it can also be transferred to withdrawal line 12C if it is indicated that clogging has occurred in the digester at strainer 11C.

Embodiment with Three Shunt Lines and Four Withdrawal Positions

The invention can be applied in one advantageous embodiment in a digester where the digester has also a fourth withdrawal position 11B where the cooking fluid is withdrawn at this fourth withdrawal position after the wood raw material has had a retention time in the digester that differs relative to that at the third withdrawal position by at least 10 minutes, preferably at least 20 minutes. A further regulator valve 18C is arranged in a shunt line 17C between the withdrawal lines for the withdrawal lines 12B and 12C at the third and fourth withdrawal positions, which regulator valve 18C is controlled by a differential pressure gauge PC that is arranged to determine both the pressure in the withdrawal line 12C at the third withdrawal position and the pressure in the withdrawal line 12B at the fourth withdrawal position.

The differential pressure between the third and fourth withdrawal positions can be determined with this embodiment, and a connection is opened between these withdrawal positions when this differential pressure exceeds a pre-determined third level.

If a downwards concurrent flow DF of cooking fluid has been established in the corresponding cooking zone in the digester between the strainers 11B and 11C, as is indicated in FIG. 1, the regulation in the shunt line 17C is adjusted so that the regulator valve 18C opens for a flow through the valve as is indicated, that is, a flow in the shunt line 17C that is parallel to the concurrent flow DF, when the differential pressure between the withdrawal line 12B that lies above and the withdrawal line 12C that lies below, when measured by the differential pressure gauge PC, falls below a pre-determined threshold value $P_{Th}$.

It is appropriate if this threshold value $P_{Th}$ is set at a level of a pressure difference of 0.1-1.0 bar between the pressure $P_{12C}$ in the withdrawal line 12C and the pressure $P_{12B}$ in the withdrawal line 12B (thus being the inverse of the regulation through the valve in the shunt over a cooking zone of countercurrent flow) according to:

$$P_{12B}-P_{12C}\geqq P_{Th}\Rightarrow \text{Valve 18}C\text{ opens.}$$

Preferably it is here that compensation is carried out for the static height (height difference) between the strainer sections $P_{OFFSET_B/C}$, where P corresponds to the difference in static pressure between these height positions 12B and 12C, such that the regulator function then becomes:

$$P_{12B}-P_{12C}-P_{OFFSET_B/C}\geqq P_{Th}\Rightarrow \text{Valve 18}C\text{ opens.}$$

Transfer of withdrawal flow from strainer 11B to 11C is achieved with this regulator function as soon as the current pressure in the withdrawal line 12C indicates that clogging has occurred in the digester.

Embodiment with Four Shunt Lines Between Five Withdrawal Positions

The invention can be applied in one advantageous embodiment in a digester where the digester has also a fifth withdrawal position 11A where the cooking fluid is withdrawn at this fifth withdrawal position after the wood raw material has had a retention time in the digester that differs relative to that at the fourth withdrawal position by at least 10 minutes, preferably at least 20 minutes. A further regulator valve 18B is also here arranged in a shunt line 17B between the withdrawal lines for the withdrawal lines 12B and 12A at the fourth and fifth withdrawal positions, which regulator valve 18B is controlled by a differential pressure gauge PC that is arranged to determine both the pressure in the withdrawal line 12B at the fourth withdrawal position and the pressure in the withdrawal line 12A at the fifth withdrawal position.

The differential pressure between the fourth and fifth withdrawal positions can be determined with this embodiment, and a connection opened between these withdrawal positions when this differential pressure exceeds a pre-determined fourth level.

If a downwards concurrent flow DF of cooking fluid has been established in the corresponding cooking zone in the digester between the strainers 11A and 11B, as is indicated in FIG. 1, the regulation in the shunt line 17B is adjusted such that the regulator valve 18B opens for a flow through the valve as is indicated, that is, a flow in the shunt line 17B that is parallel to the concurrent flow DF, when the differential pressure between the withdrawal line 12A that lies above and the withdrawal line 12B that lies below, when measured by the differential pressure gauge PC, falls below a pre-determined threshold value $P_{Th}$.

It is appropriate if this threshold value $P_{Th}$ is set at a level of a pressure difference of 0.1-1.0 bar between the pressure $P_{12B}$ in the withdrawal line 12B and the pressure $P_{12A}$ in the withdrawal line 12A (thus being the inverse of the regulation through the valve in the shunt over a cooking zone of countercurrent flow) according to:

$$P_{12A}-P_{12B}\geqq P_{Th}\Rightarrow \text{Valve 18}B\text{ opens.}$$

Preferably it is here that compensation is carried out for the static height (height difference) between the strainer sections $P_{OFFSET_A/B}$, where $P_{OFFSET_A/B}$ corresponds to the difference in static pressure between these height positions 12A and 12B, such that the regulator function then becomes:

$$P_{12A}-P_{12B}-P_{OFFSET_A/B}\geqq P_{Th}\Rightarrow \text{Valve 18}B\text{ opens.}$$

Transfer of withdrawal flow from strainer 11A to 11B is achieved with this regulator function as soon as the current pressure in the withdrawal line 12B indicates that clogging has occurred in the digester.

Embodiment with Shunt Lines Also for the Addition of Washing Fluid at the Bottom In one advantageous embodiment in which washing fluid is added at the bottom of the digester through addition nozzles 6A-6C through a pressurised washing line WL/6, a regulator valve 18F is also arranged in a shunt line 17F between the withdrawal line 12E for the withdrawal position at the bottom of the digester and the washing fluid line WL/6. The regulator valve is controlled by a differential pressure gauge PC arranged to determine both the pressure in the washing fluid line WL/6 and the pressure in the withdrawal line 12E for the withdrawal position at the bottom of the digester.

The differential pressure between the washing fluid line and the withdrawal position that is arranged at the bottom of the digester can be determined with this embodiment, and when this differential pressure exceeds a pre-determined sixth level, a connection is opened between the washing fluid line and this withdrawal position.

This occurs in a manner similar to that that occurs in the shunt lines 17E and 17D if a countercurrent flow UF is established in the digester.

Embodiment with Shunt Lines Also to the Top Separator

The shunt lines between the withdrawal positions and the return line are coordinated in one advantageous embodiment in which cooking fluid is withdrawn at the top of the digester in a top strainer 4 in direct connection with the top of the digester and where the top strainer 4 withdraws cooking fluid from the wood raw material before this raw material has had any substantial retention time in the digester, for return to the input system 1 of the digester via a return line 3. A regulator valve 18A can in this case be arranged in a shunt line 17A between the return line 3 and the withdrawal line 12A for the withdrawal position 11A that is arranged at the top of the digester while remaining below the top strainer 4. The regulator valve is controlled by a differential pressure gauge PC that is arranged to determine both the pressure in the return line 3 and the pressure in the withdrawal line 12A for the withdrawal position (11A) that is arranged at the top of the digester while remaining below the top strainer.

The differential pressure between the return line and the withdrawal position that is arranged at the top of the digester, while remaining below the top strainer, can be determined in this embodiment, and when this differential pressure exceeds a pre-determined seventh level, a connection opens between the return line and the withdrawal position at the top of the digester, while remaining below the top strainer.

This takes place in a similar manner as in the shunt lines 17C and 17B if a concurrent flow DF is established in the digester between the top strainer 4 and the upper withdrawal strainer 11A.

In an application with a hydraulic digester, compensation for the static height takes place in a similar manner as for intermediate strainers, while for steam phase digesters compensation takes place also for a local difference in height between the level of fluid in the top strainer and the level of fluid in the steam phase.

Shunt Lines Between all Withdrawal Positions from the Bottom up to the Return Withdrawal Regulator valves 18D, 18E are installed in another suitable embodiment in shunt lines 17D, 17E connected between all adjacent withdrawal positions 11C-11E from the bottom of the digester and up to the uppermost withdrawal position 11C in which cooking fluid is withdrawn in order to be led to the recovery process (REC), possibly after its use for black liquor impregnation, where each one of these regulator valves is controlled by a differential pressure gauge PC that determines the pressure in the relevant withdrawal line for the adjacent withdrawal position.

The differential pressure between all withdrawal positions from the bottom of the digester up to the uppermost withdrawal position at which cooking fluid is withdrawn in order to be led to recovery can be determined in this embodiment, and when the differential pressure between any one of these adjacent withdrawal positions exceeds pre-determined levels, connections between the relevant adjacent withdrawal positions are opened; being, however, restricted to those withdrawal positions that are present in the digester under the position of the withdrawal to the recovery process. This variant is particularly suitable if it is desired to reduce the risk that cooking fluid with a high level of residual alkali is withdrawn to the recovery process.

Shunt Lines Between all Withdrawal Positions in the Digester

A shunt line 17B-17E between the withdrawal line 12A-12E of each adjacent withdrawal position is located between each withdrawal position 11A-11E throughout the digester in one preferred embodiment, and a regulator valve 18B-18E is located in each shunt line and is controlled by a differential pressure gauge PC, which determines the pressure in the relevant withdrawal line at the adjacent withdrawal position.

The differential pressure between all withdrawal positions throughout the complete digester at which cooking fluid is withdrawn can be determined with this embodiment. Connections are opened between the relevant adjacent withdrawal positions when the differential pressure between any one of these adjacent withdrawal positions exceeds predetermined levels.

The pre-determined levels at which the connection opens can be set to the same offset level in certain embodiments. It is appropriate that all differential pressure gauges should be reset when the system is full (full digester), whereby each differential pressure gauge is reset with respect to the static height difference between two adjacent withdrawal positions, as has been previously described using the term $P_{OFFSET_U/L}$. For example, if there is a distance of 5 meters between two adjacent withdrawal positions, an upper and a lower position with their associated static pressures $P_U$ and $P_L$, then the static differential pressure is 0.5 bar. Using a pre-determined threshold value of 0.2 bar and using differential pressure gauges that are reset when the system is full, the connection is opened only when the pressures between these withdrawal positions differ by 0.5±0.2 bar.

Other Embodiments

The withdrawal position in the continuous digester can be a cooking flow in which cooking fluid is withdrawn from the digester through a cooker strainer 11A-11E arranged in the wall of the digester and is then conditioned in an external treatment process before its return to the digester through central pipes 13A, 13B, 13E at the same level as the relevant withdrawal position 11A, 11B and 11E. The conditioning of the cooking fluid may involve at least one of:

- heating 16A,16B,16E,
- addition of cooking chemicals, preferably alkali,
- withdrawal of consumed cooking fluid from the digester to the recovery process REC,
- withdrawal of consumed cooking fluid in a pre-impregnation step for the wood raw material, or
- replacing withdrawn cooking fluid that has a high content of released (organic) material with other fluid that has a lower content of (organic) material.

It is appropriate that the shunt line is located arranged to be connected between adjacent withdrawal lines and, when viewed in the direction of flow in the cooker, before a circulatory pump 15A-15E arranged in the relevant cooker flow.

Figure 2:
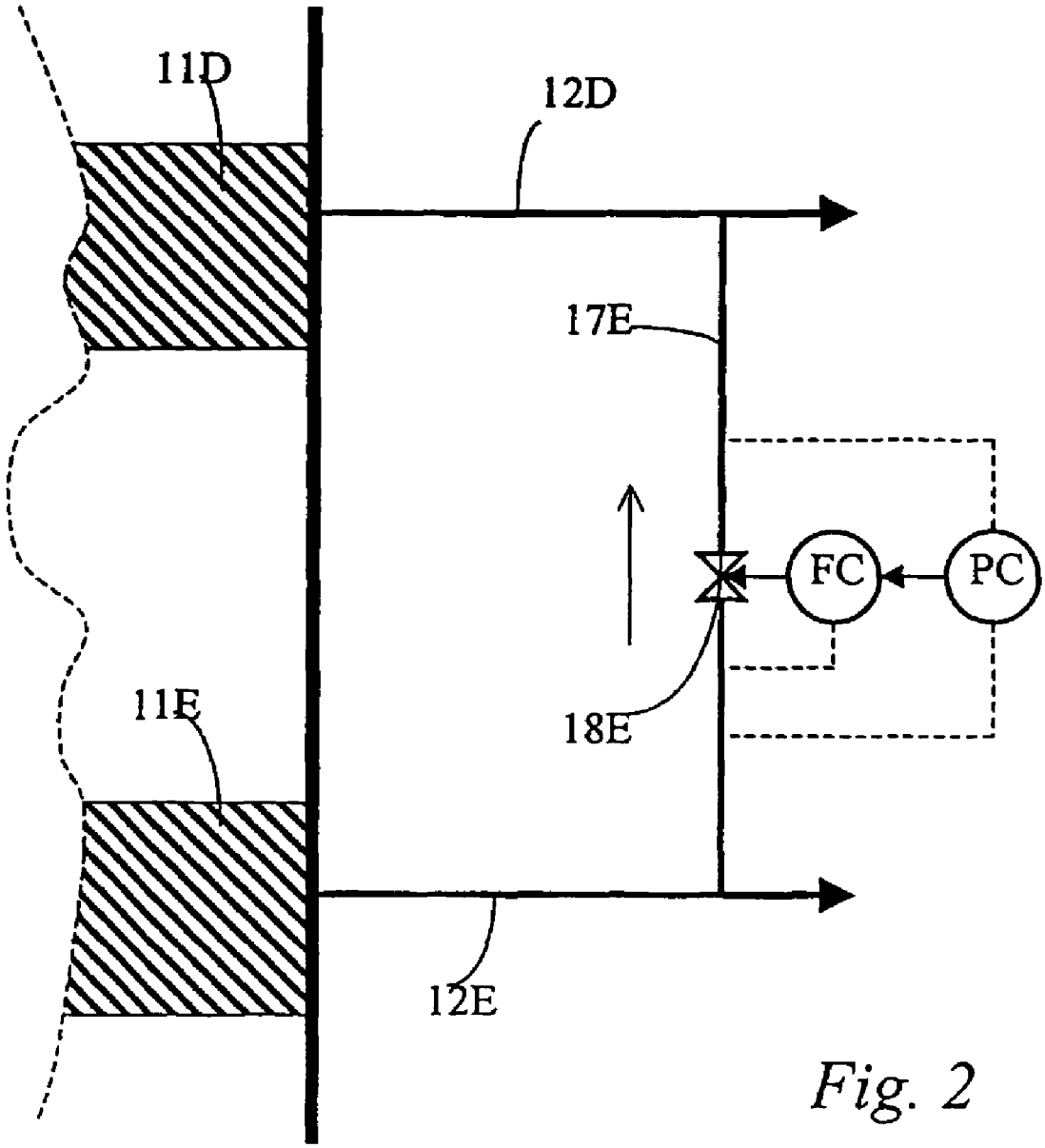
FIG. 2 shows an advantageous embodiment of a flow regulation between two withdrawal positions according to the invention.

FIG. 2 also shows a supplement of at least one shunt line, shown in the lower shunt line 17E from FIG. 1. A flow regulator FC is located here in order to control the valve 18E. This flow regulator can be used to set limits for the volume that is led past the valve. It is also easy to log the current flow as a function of time in order to be able to determine the operating conditions under which interruptions of the normal withdrawal flows (when the valves 18A-18F are closed) arise.

Figure 3:
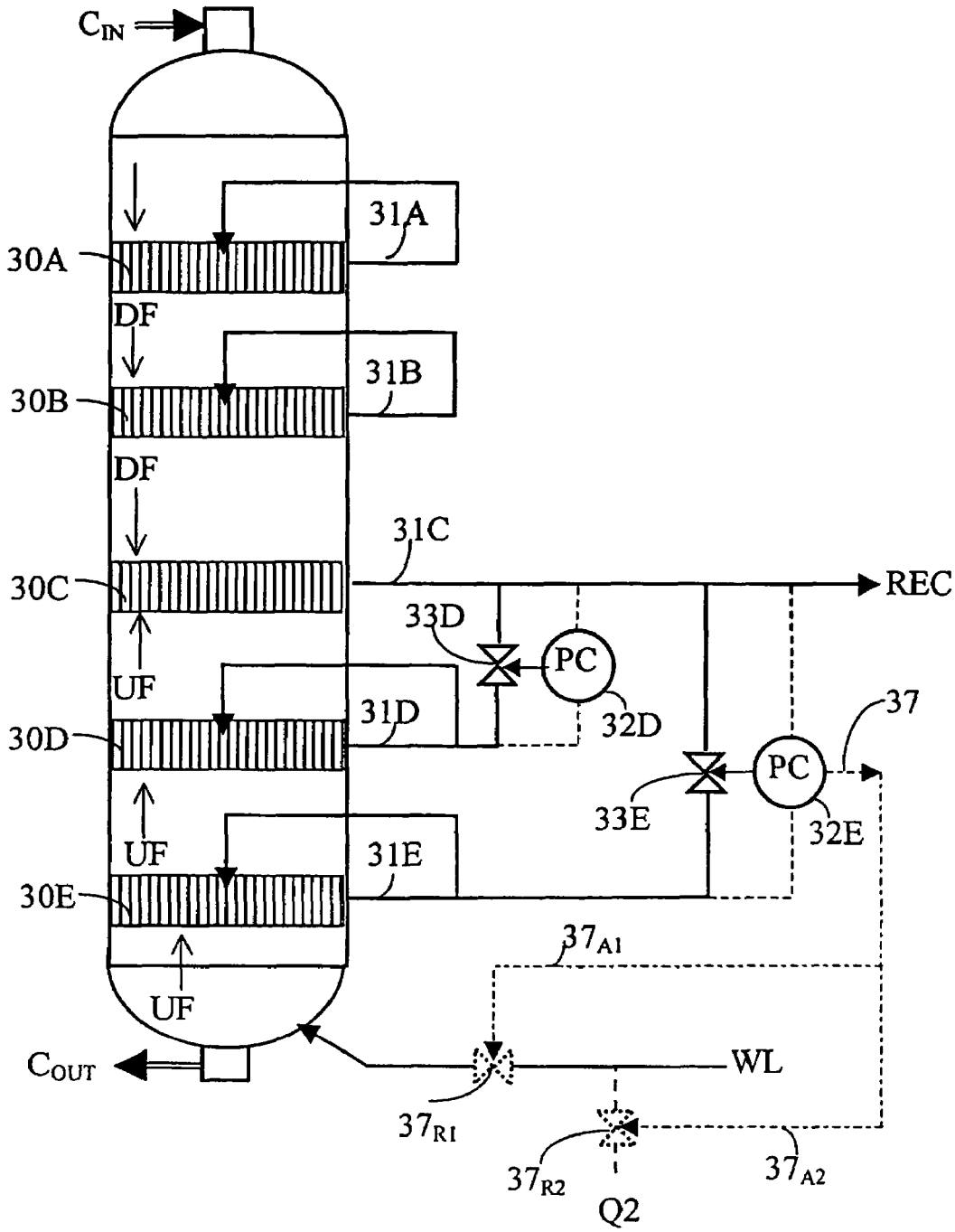
FIG. 3 shows a first variant of the invention.

FIG. 3 shows schematically a first variant of the invention where the shunt line from the lowermost strainer 30E is connected past the strainer 30D to the withdrawal line 31C. Shunting of the flow at the withdrawal position 31D according to the invention is also shown here, from the strainer 30D up to the withdrawal line 31C. This variant can also be implemented in the withdrawal flows 31A and 31B that lie above, such that the flow 31A can be shunted down to the withdrawal position 31C, and the flow 31B can in the same way be shunted down to withdrawal position 31C.

It is also possible in this case to supplement the control of the shunt flows with an influence on the diluting fluid/washing fluid WL that is added to the bottom of the digester, with the aim of further reducing the opposing force on the column of chips from the upward flow. Regulation of the addition of diluting fluid/washing fluid WL can also take place when the shunt valve 33E opens. This regulation of the addition of dilution fluid/washing fluid can either take place through cutting the flow in the addition line with a throttle valve $\mathbf{37}_{R1}$ or by leading a part of the diluting fluid/washing fluid away in a flow Q2 through a regulator valve $\mathbf{37}_{R2}$.

Q2 can either be led to an upper circulation 31A/31B where the downwards flow is reinforced, or it can be led away from the system, possibly through the withdrawal REC.

It is the case for all of these withdrawal strainers that they are arranged at different heights in the digester where the wood raw material has had a retention time in the digester that differs by at least 10 minutes, and preferably at least 20 minutes, between the withdrawal strainers arranged in the digester, that is: from withdrawal strainer 30A to 30B, from withdrawal strainer 30B to 30C, etc., and down to the lowermost trainer 30E.

Figure 4:
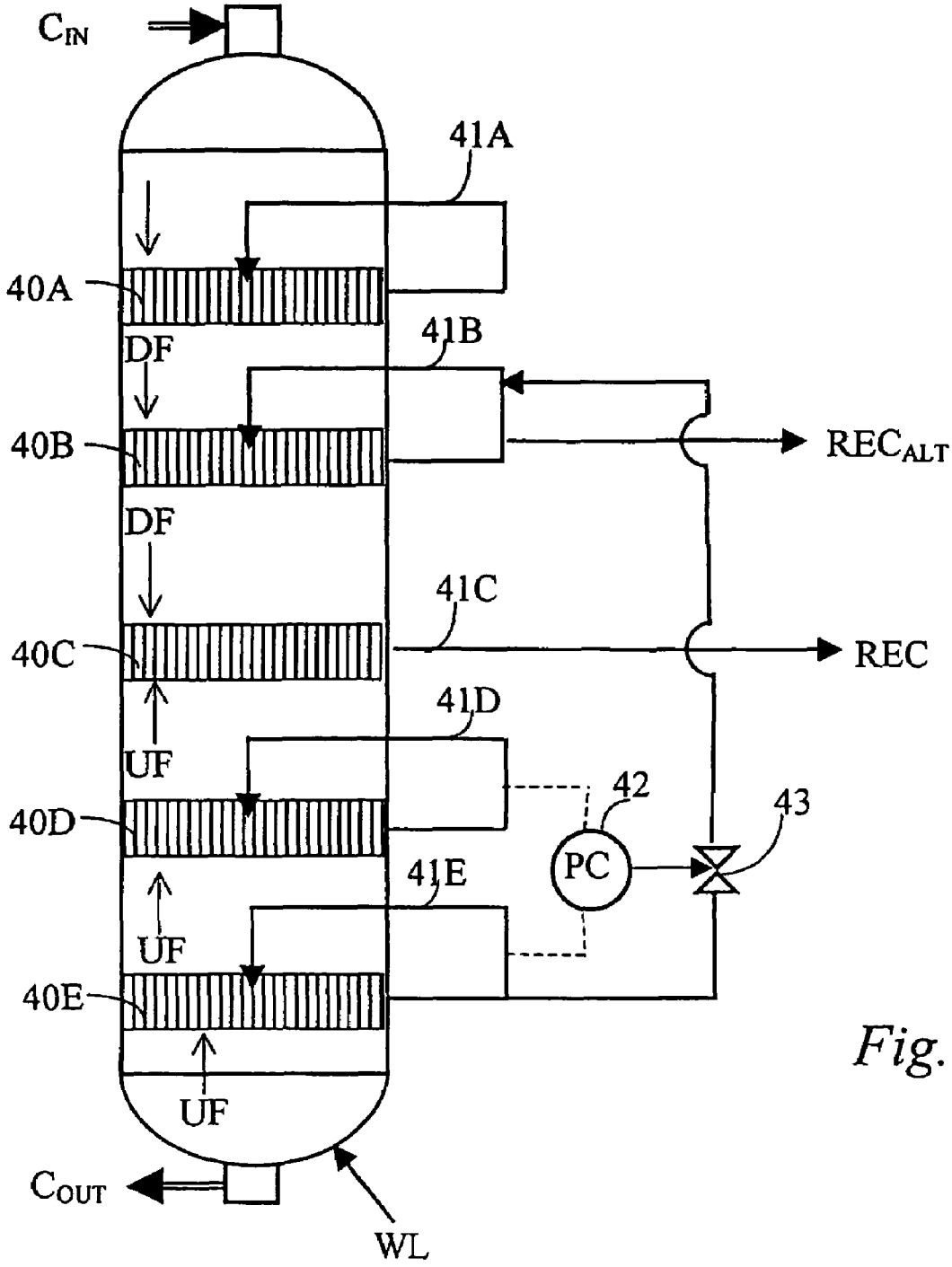
FIG. 4, shows a second variant of the invention.

FIG. 4 shows schematically a second variant in which the shunting of the flow from the lowermost flow 41E according to the invention is shunted up to a cooking flow 41B, preferably arranged above the principal withdrawal 41C/REC from the digester.

It is possible here to use as additional fluid to the flow 41B a washing fluid with a low content of released organic material, and this additional fluid replaces cooking fluid with a high content of released organic material that is withdrawn $REC_{ALT}$ to a recovery process or to pre-impregnation.

The invention can be modified in a number of ways within the framework of the attached claims.

For example, the pumps 15A, 15B and 15E can in certain applications be located in front of the main shunt line 17A-17F, instead of after as is shown in FIG. 1.

The measurement of differential pressure can also be determined by measurement not only in the column of chips, but also in the withdrawal/collection channel for withdrawn cooking fluid, which withdrawal channel is located on the outer side of the strainer. The differential pressure across the strainer can be measured using this type of measurement, and this pressure can be used to determine if the strainer in question shows a tendency to clogging, or if it is difficult to drain the column of chips at any moment.

While the present invention has been described in accordance with preferred compositions and embodiments, it is to be understood that certain substitutions and alterations may be made thereto without departing from the spirit and scope of the following claims.

The invention claimed is:

1. A method for the continuous cooking of wood raw material for the production of cellulose pulp, comprising:

feeding a wood raw material and a cooking fluid to a top of a continuous digester;

establishing a cooking temperature of 130-170° in the digester while the wood raw material experiencing a retention time of at least 90 minutes at the cooking temperature;

the wood raw material sinking continuously through the digester from the top down to a bottom of the digester in order to finally expelling the wood raw material from the bottom of the digester;

arranging a first withdrawal position in the digester for the cooking fluid and arranging a second withdrawal position in the digester for the cooking fluid, the second withdrawal position being above the first withdrawal position;

withdrawing cooking fluid at the first and second withdrawal positions, the wood raw material having experienced a first retention time in the digester at the first withdrawal position and a second retention time in the digester at the second withdrawal position, the first retention time being at least 10 minutes different from the second retention time;

establishing a zone of a countercurrent or a concurrent flow in the digester between the first and second withdrawal positions;

providing an openable shunt line extending between the first withdrawal position and the second withdrawal position, the shunt line being in a closed position;

a differential pressure (ΔP) between the second withdrawal position and the first withdrawal position falling below a first predetermined threshold value or rising above a second predetermined threshold value; and opening the shunt line extending between the first and second withdrawal positions.

2. The method according to claim 1 wherein the first withdrawal position is constituted by a first withdrawal strainer that is located at the bottom of the digester in a wall section of the digester, and wherein the second withdrawal position is constituted by a second withdrawal strainer that is located above the first withdrawal strainer at a sufficient distance to ensure that the wood raw material at the second withdrawal strainer has had the first retention time that is at least 10 minutes, shorter in the digester compared to the first retention time of the wood raw material at the first withdrawal strainer and where a physical distance between the first and second withdrawal strainers is at least 2 meters, and wherein the digester has a third withdrawn position above the second withdrawal position so that cooking fluid at the third withdrawal position is withdrawn after the wood raw material has had a retention time in the digester that is shorter and differs relative to the second withdrawal position by at least 10 minutes, and wherein a zone of concurrent flow or countercurrent flow is established in the digester between the second and the third withdrawal positions, establishing a zone of a concurrent flow in the digester between second withdrawal position and the third withdrawal position;

providing an openable shunt line extending between the second withdrawal position and the third withdrawal position, the shunt line being in a closed position;

a differential pressure (ΔP) between the third withdrawal position and the second withdrawal position rising above a third predetermined threshold value; and opening the shunt line extending between the second and third withdrawal positions.

3. The method according to claim 2 wherein the digester has a fourth withdrawal position so that cooking fluid at a fourth withdrawal position is withdrawn after the wood raw material has had a retention time in the digester that differs relative to that at the third withdrawal position by at least 10 minutes, and wherein a zone of countercurrent flow of concurrent flow is established in the digester between the third and the fourth withdrawal positions, a differential pressure (ΔP) between the third and the fourth withdrawal positions is determined.

4. The method according to claim 3 wherein the digester has a fifth withdrawal position so that cooking fluid at this fifth withdrawal position is withdrawn after the wood raw material has had a retention time in the digester that differs relative to that at the fourth withdrawal position by at least 10 minutes, and where a cooking zone of countercurrent flow or concurrent flow is established in the digester between the fourth and fifth withdrawal positions, a differential pressure between the fourth and the fifth withdrawal positions is determined.

5. The method according to claim 1 wherein the first connection opens such that a flow in the first connection between the first and second withdrawal positions becomes parallel to a flow of cooking fluid established in the digester through a column of chips between the first and second withdrawal strainers.

6. The method according to claim 1 wherein washing fluid is added at the bottom of the digester through a pressurized washing fluid line, a differential pressure between the washing fluid line and the first withdrawal position is determined.

7. The method according to claim 1 wherein wood raw material and cooking fluid are added at the top of the digester during the withdrawal of cooking fluid at the top of the digester in a top strainer in direct connection with the top of the digester, and wherein the top strainer withdraws cooking fluid from the wood raw material before the wood raw material has experienced any significant retention time in the digester, the cooking fluid is returned to the input system of the digester through a return line, a differential pressure is determined between the return line and a withdrawal position that is arranged at the top of the digester and below the top strainer.

8. The method according to claim 1 wherein differential pressures between all withdrawal positions from the bottom of the digester up to an uppermost withdrawal position at which cooking fluid is withdrawn in order to be led away to a recovery process, are determined.

9. The method according to claim 1 wherein differential pressures between all withdrawal positions in the digester at which cooking fluid is withdrawn are determined.

10. The method according to claim 1 wherein cooking fluid is conditioned in an external treatment before being returned to the digester.

* * * * *